United States Patent [19]

Stitz

[11] Patent Number: 4,932,598

[45] Date of Patent: Jun. 12, 1990

[54] YARN WINDING MACHINE

[75] Inventor: Albert Stitz, Kürten, Fed. Rep. of Germany

[73] Assignee: Barmag AG, Remscheid, Fed. Rep. of Germany

[21] Appl. No.: 417,888

[22] Filed: Oct. 6, 1989

[30] Foreign Application Priority Data

Oct. 6, 1988 [DE] Fed. Rep. of Germany ..... 3834032

[51] Int. Cl.[5] ..... B65H 54/40

[52] U.S. Cl. ..... 242/18 R; 242/18 DD

[58] Field of Search ..... 242/18 R, 18 DD, 18 CS, 242/45, 75.5, 75.51, 65, 66, 36, 18 A

[56] References Cited

U.S. PATENT DOCUMENTS

| | | | |
|---|---|---|---|
| 3,917,182 | 11/1975 | Lenk | 242/18 R |
| 3,930,744 | 1/1976 | Theis, Jr. . | |
| 3,973,739 | 8/1976 | Nilgens et al. | 242/18 R |
| 3,976,389 | 8/1976 | Theis, Jr. . | |
| 4,043,517 | 8/1977 | Jährig | 242/18 R X |
| 4,106,710 | 8/1978 | Schippers et al. | 242/18 R |
| 4,150,918 | 4/1979 | Theis, Jr. . | |
| 4,203,560 | 5/1980 | Isoard | 242/18 DD X |

FOREIGN PATENT DOCUMENTS

| | | |
|---|---|---|
| 0097605 | 1/1984 | European Pat. Off. . |
| 3513796 | 12/1985 | Fed. Rep. of Germany . |
| 3610368 | 10/1986 | Fed. Rep. of Germany . |
| 1572934 | 8/1980 | United Kingdom . |

*Primary Examiner*—Stanley N. Gilreath

*Attorney, Agent, or Firm*—Bell, Seltzer, Park & Gibson

[57] ABSTRACT

The invention relates to a high speed yarn winding machine for winding a filament yarn, and which comprises a motor-driven winding spindle and a contact roll rotatingly resting against the surface of a yarn package being wound on the spindle, and with the contact roll serving to guide the yarn onto the package. The contact roll is adapted to be raised from the package surface during a package doff, and it can be rotatably driven while in its raised position by an air turbine wheel, which is co-axially connected to the contact roll. The wheel is provided with two annular rings of recesses which are concentric to its axis, and an air supply system is provided which is able to selectively direct compressed air toward either one of the two rings of recesses, to thereby permit the turbine wheel and thus the contact roll to be rotated in either direction. Thus the rotational speed of the contact roll may be maintained during a package doff, or reduced in speed or stopped in case of a malfunction in the yarn transfer to a new package.

9 Claims, 2 Drawing Sheets

YARN WINDING MACHINE

BACKGROUND OF THE INVENTION

The present invention relates to a yarn winding machine for winding a filament yarn, of the type generally disclosed in DE-OS 36 103 68. Such winding machines are suitable for winding speeds of more than 6,000 meters per minute, and they typically comprise a rotatable spindle adapted for having a bobbin supported yarn package wound thereupon, and a contact roll which is mounted for rotation about an axis parallel to that of the spindle and which is adapted to engage the surface of the package being wound on the spindle. Also, the contact roll is mounted by a carriage which lifts it from the surface of the package during the package doffing process.

It is, furthermore, recognized that the yarn transfer operation during the package doff at the indicated high winding speeds may lead to malfunctions, in that so-called laps are formed on the roll. Therefore, also a separate braking mechanism is provided for slowing the speed of rotation of the contact roll.

It is an object of the present invention to provide a yarn winding machine which permits the speed of the contact roll to be accurately and efficiently controlled when it is lifted from the winding spindle, so as to provide alternately optimum rotational speed or braking during the doffing process.

In view of the high speed, no slippage should occur between the yarn and the contact roll during the doffing operation. Therefore, the contact roll has been coupled with a turbine which drives the contact roll during the package doff and which maintains a constant speed.

SUMMARY OF THE INVENTION

The above and other objects and advantages of the present invention are achieved in the embodiment illustrated herein by the provision of a yarn winding machine which comprises a rotatable spindle adapted for having a bobbin supported yarn package wound thereupon, and a contact roll mounted for rotation about an axis parallel to that of the spindle and which is adapted to engage the surface of the package being wound on the spindle. A turbine wheel is coaxially mounted to the contact roll, with the turbine wheel including two distinct annular rings of recesses. Means are also provided for selectively supplying compressed air to each of the two annular rings of recesses, and with the annular rings of recesses and the air supplying means being configured such that the air supplied to one of the rings acts to rotate the contact roll in a predetermined rotational direction, and the air supplied to the other of the rings acts to resist rotation in the predetermined rotational direction.

The contact roll may be lifted from the surface of the package being wound on the spindle, and in the raised position of the contact roll, the turbine wheel and thus the contact roll may be driven by the compressed air in opposite rotational directions. The driving torque and speed of the contact roll, and the braking moment, can easily be selected when the roll is in the raised position, by adjusting the air pressure of the air supplying means.

For the purpose of admitting compressed air, each of the two rings of recesses is associated with a compressed air chamber, which is preferably annular and concentrically arranged, and which connects to a source of compressed air. Each of these air chambers is provided with a plurality of air outlet openings, which are aligned in accordance with the biasing direction of the respective ring of recesses, and thus the turbine wheel and contact roll.

Preferably, one of the rings of recesses comprises recesses which are uniformly arranged on the peripheral surface of the turbine wheel. These rings are surrounded by an annular compressed air chamber, which has a plurality of air outlet openings which lie in the normal plane of the recesses and are directed along a tangent or secant toward the peripheral surface of the turbine wheel.

The other ring of recesses is formed by uniformly arranged bores which extend laterally through the turbine wheel. Each bore is angled in the area of the central normal plane of the turbine wheel, and the outlet ends of the bores are so directed that their axes extend between the tangent and a line perpendicular to the surface of the turbine wheel. Associated with this second ring is a compressed air chamber which is concentric thereto, and arranged at one side of the turbine wheel. This second air chamber is provided with a plurality of air outlet openings which extend in the direction of the inlet opening of the bores of the second ring. As an alternative to the described construction, it is also possible that the two separate rings of the present invention be in the form of two concentric rings of such bores in the turbine wheel.

The compressed air chambers are connected via valves with a source of compressed air, and the valves are thus in a position to selectively bias one of the rings of recesses with compressed air, so that the contact roll connected to the turbine wheel can be either accelerated or slowed down. Thus, it is ensured that the speed of the contact roll can be maintained during a package doff or, if need be in the case of a yarn transfer malfunction, it can be quickly reduced and brought to zero.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
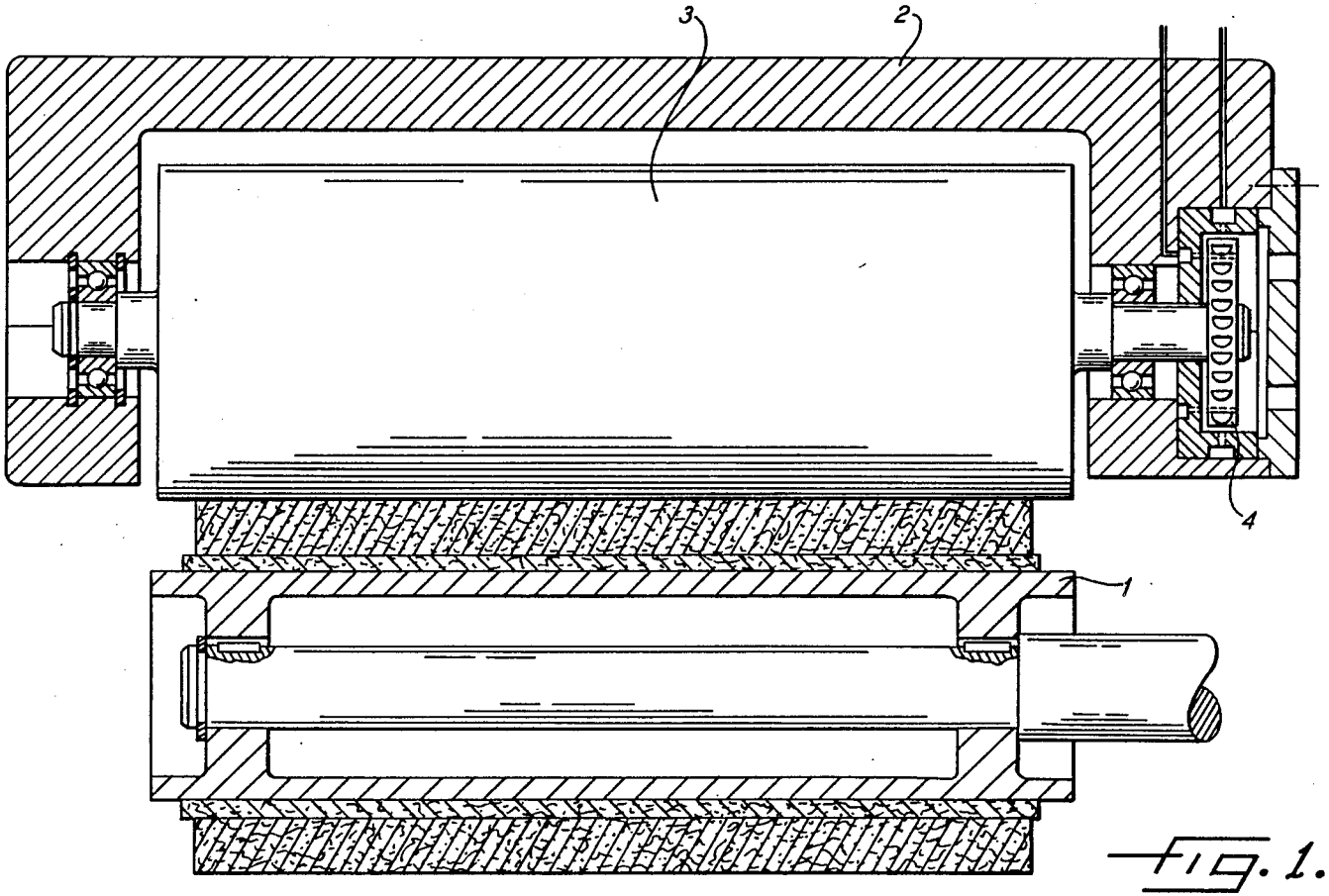
FIG. 1 is a sectional view of a yarn winding machine which embodies the present invention.

Referring more particularly to the drawings, FIG. 1 is a sectional view of a yarn winding machine of the present invention, and which comprises a motor-driven winding spindle 1. As illustrated, a yarn bobbin is coaxially mounted on the spindle 1, and a yarn package is partially wound on the bobbin. The machine further comprises a drivable contact roll 3, which rotatingly rests against the package and is rotatably supported in a mounting carriage 2. The carriage 2 is adapted to move radially away from the spindle 1 during the package build, and to be lifted away from the package during a package doff, in a conventional manner.

Figure 2:
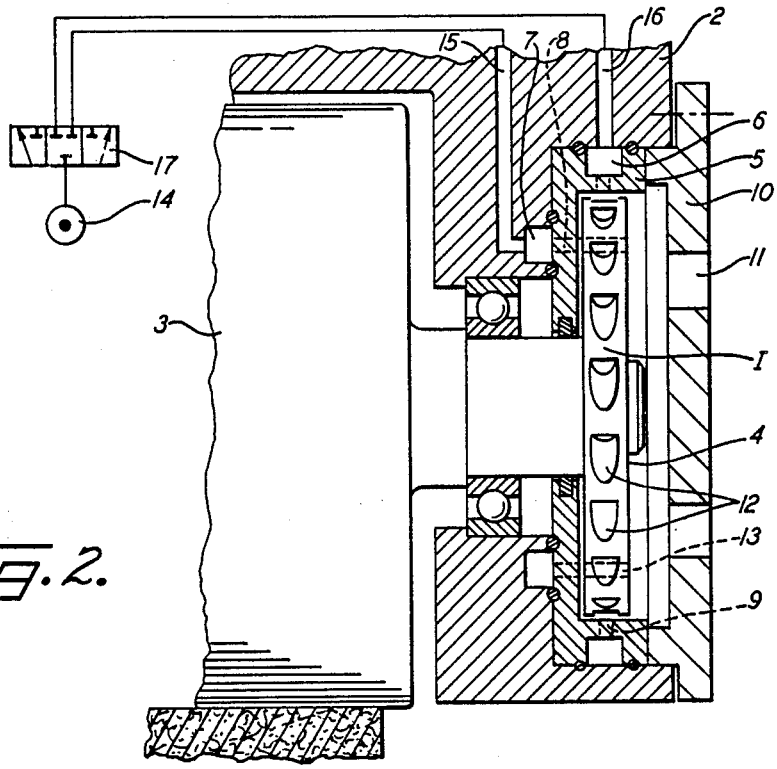
FIG. 2 is a sectional view of the turbine wheel shown in FIG. 1.
Figure 3:
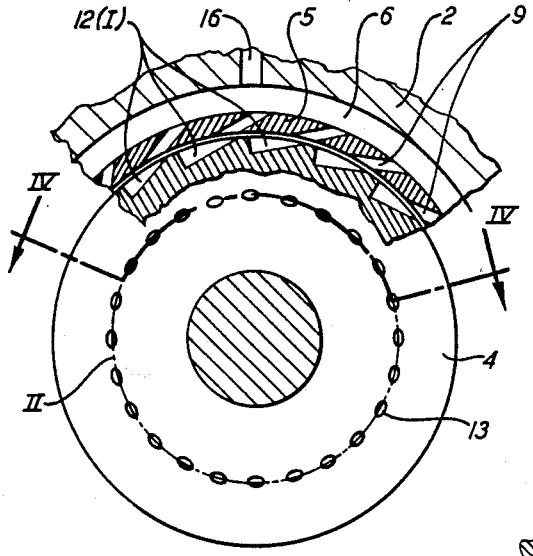
FIG. 3 is a partially sectioned front end view of the turbine wheel, showing the first ring of recesses located on its circumference, and its associated compressed air chamber.

As is best seen in FIG. 2, the drive of the contact roll is provided by a turbine wheel 4 which is co-axially and rigidly connected to the roll. The peripheral surface of the wheel 4 includes a plurality of recesses 12 which are equally distributed in a ring I about the peripheral surface of the wheel. As best seen in FIG. 3, each of the recesses 12 includes a generally radially directed shoulder and an inclined surface. The wheel 4 also includes a second ring II of recesses which are in the form of bores 13 which extend laterally through the wheel, and with this second ring II being arranged coaxially inside of the ring I.

A housing 5 and a cover 10 enclose the turbine wheel 4, and the housing 5 defines an annular compressed air chamber 6 which concentrically surrounds the peripheral surface of the wheel, and thus the ring of recesses 12. A plurality of openings 9 extend from the air chamber toward the ring of recesses 12 in an inclined, i.e. non-radial direction. A second annular compressed air chamber 7 is positioned along one side of the wheel, and a plurality of openings 8 extend from the second chamber 7 toward the ring of bores 13. By this construction, the turbine wheel 4 is able to cause the contact roll 3 to rotate in one of the two possible directions, i.e., it accelerates or brakes the roll. The cover 10 has air outlet openings II, and is rigidly connected with the mounting carriage 2.

As can also be seen in FIG. 2, the compressed-air chambers 6, 7 are connected with a source of compressed air 14 via conduits 15, 16 and a valve control 17, so that, when needed, compressed air can be directed into one of the two compressed air chambers 6 or 7 which air biases through the air outlet openings 8 or 9 of the two rings of recesses (FIGS. 2, 3, 4) and, thus, accelerates or brakes the rotating turbine wheel 4 and the contact roll 3. Thus when the carriage 2 and contact roll 3 are lifted from the winding spindle 1 or the package surface, the roll 3 may be accelerated or braked by biasing one of the two rings of recesses (FIGS. 2, 3, 4) with the compressed air.

Figure 4:
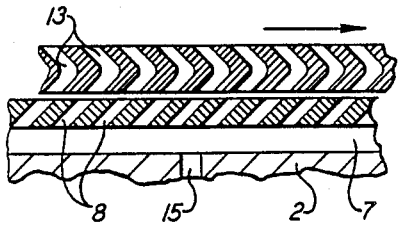
FIG. 4 is a sectional view taken substantially along the line IV—IV of FIG. 3 and illustrating the second ring of recesses together with the associated compressed air chamber.

FIGS. 3 and 4 are more detailed views of the two compressed air chambers 6 and 7 associated with the two rings of recesses and the respective air outlet openings 8 and 9. FIG. 3 shows the recesses 12 on the circumference of the turbine, whereas FIG. 4 shows the angled bores 13, which form the second ring II. The bores 13 are of V-shaped outline, and the inlet portions of the bores have the same inclination as the air outlet openings 8. The bores are angled in the normal plane of the turbine wheel 4, and their outlet ends are so directed that the axes of the bores extend between the tangent and a line perpendicular to the surface of the ring II.

When the contact roll 3 is lifted from the winding spindle or the package surface, and the compressed-air chamber 6 is connected with the source 14 of compressed-air, the ring I is biased anticlockwise, and the turbine wheel and the contact roll, which are assumed to rotate clockwise because they rest against the spindle, are braked. A connection of the compressed air chamber 7 with the source 14 of compressed air results in the biasing of the ring II and, thus, in a clockwise acceleration of the rotary movement.

The above described construction thus ensures that the speed of the contact roll 3 is maintained during a package doff, or reduced in cases of a malfunction, and that the contact roll can be readily stopped if desired. The design is mechanically simple, and the braking system substantially utilizes means which must in any event be present for the drive.

In the drawings and specification, there has been set forth a preferred embodiment of the invention, and although specific terms are employed, they are used in a generic and descriptive sense only and not for purposes of limitation.

That which is claimed is:

1. A yarn winding machine comprising a rotatable spindle adapted for having a bobbin supported yarn package wound thereupon, a contact roll mounted for rotation about an axis parallel to that of said spindle and adapted to engage the surface of the package being wound on said spindle, turbine wheel means coaxially mounted to said contact roll, with said turbine wheel means including two distinct annular rings of recesses, and means for selectively supplying compressed air to each of said annular rings of recesses, and with said annular rings of recesses and said air supplying means being configured such that the air supplied to one of said rings acts to rotate the contact roll in a predetermined rotational direction, and the air supplied to the other of said rings acts to resist rotation in said predetermined rotational direction.

2. The yarn winding machine as defined in claim 1 wherein said turbine wheel means comprises a turbine wheel mounted adjacent one end of said contact roll, and one of said annular rings of recesses comprises a plurality of recesses equally distributed about the peripheral surface of said turbine wheel, and said air supplying means includes a first annular air chamber surrounding said peripheral surface of said turbine wheel, and a plurality of openings each extending from said air chamber toward said one annular ring of recesses in a non-radial direction.

3. The yarn winding machine as defined in claim 2 wherein the other of said annular rings of recesses comprises an annular ring of bores extending laterally through said turbine wheel, and said air supplying means further comprises a second air chamber disposed adjacent one side of said turbine wheel, and a plurality of openings each extending from said second chamber toward said annular ring of bores.

4. The yarn winding machine as defined in claim 3 wherein said bores are each of V-shaped outline in cross section and so as to define an inlet bore portion which is adjacent said second air chamber and an outlet bore portion, and wherein said openings extending from said second air chamber are inclined to substantially match the inclination of said inlet bore portions.

5. A yarn winding machine comprising a rotatable spindle adapted for having a bobbin supported yarn package wound thereupon, drive motor means for rotatably driving said spindle, a contact roll, means mounting said contact roll and said spindle for rotation about parallel axes and so that the contact roll engages the surface of the package being wound on said spindle, and so as to permit radial distance between the contact roll and said spindle to increase during the build of a package thereupon, a turbine wheel coaxially mounted to said contact roll, said turbine wheel including a first annular ring of recesses distributed about the peripheral surface of said wheel and a second annular ring of recesses formed on said wheel and arranged coaxially inside of said first rings of recesses, and means for selectively supplying compressed air to said first and second rings of recesses, and such that air supplied to one of said rings acts to rotate said contact roll in a predetermined rotational direction and air supplied to the other of said rings acts to resist rotation in said predetermined rotational direction.

6. The yarn winding machine as defined in claim 5 wherein said first ring of recesses is equally spaced about the peripheral surface of said wheel, and said second ring of recesses comprises a plurality of equally spaced bores extending laterally through said wheel.

7. The yarn winding machine as defined in claim 6 wherein said air supplying means comprises a first annular air chamber surrounding the peripheral surface of said wheel and a plurality of openings extending from said first air chamber toward the peripheral surface of said wheel in a non-radial direction, and a second air chamber disposed adjacent one side of said wheel and a plurality of openings extending from said second air chamber toward said second ring of recesses.

8. The yarn winding machine as defined in claim 7 wherein said bores are each of V-shaped outline in cross section and so as to define an inlet bore portion which is adjacent said second air chamber and an outlet bore portion, and wherein said openings extending from said second air chamber are inclined to substantially match the inclination of said inlet bore portions.

9. The yarn winding machine as defined in claim 8 wherein the recesses of said first ring of recesses each include a generally radially directed shoulder, and wherein said openings extending from said first air chamber are inclined so as to direct air against said shoulders.

* * * * *